US007905107B2

(12) United States Patent
Forkosh et al.

(10) Patent No.: US 7,905,107 B2
(45) Date of Patent: Mar. 15, 2011

(54) HIGH EFFICIENCY DEHUMIDIFIERS AND COMBINE DEHUMIDIFYING/AIR-CONDITIONING SYSTEMS

(75) Inventors: Mordechai Forkosh, Haifa (IL); Dan Forkosh, Atlit (IL); Tomy Forkosh, Haifa (IL)

(73) Assignee: DUCool, Kibbutz HaHotrim (IL)

( * ) Notice: Subject to any disclaimer, the term of this patent is extended or adjusted under 35 U.S.C. 154(b) by 1733 days.

(21) Appl. No.: 10/500,053

(22) PCT Filed: Dec. 27, 2001

(86) PCT No.: PCT/IL01/01207

§ 371 (c)(1),
(2), (4) Date: Jun. 24, 2004

(87) PCT Pub. No.: WO03/056249

PCT Pub. Date: Jul. 10, 2003

(65) Prior Publication Data

US 2004/0261440 A1 Dec. 30, 2004

(51) Int. Cl.
*F25D 17/06* (2006.01)

(52) U.S. Cl. ..... 62/271; 62/94

(58) Field of Classification Search ..... 62/92, 93, 62/94, 101, 242, 271, 191, 940, 939
See application file for complete search history.

(56) References Cited

U.S. PATENT DOCUMENTS

| | | | | |
|---|---|---|---|---|
| 2,017,027 | A | 10/1935 | Forrest | |
| 2,057,938 | A | 10/1936 | Crawford | |
| 2,162,158 | A | 6/1939 | Coey | |
| 2,214,880 | A | 9/1940 | Crawford | |
| 2,290,465 | A | 7/1942 | Crawford | |
| 2,336,674 | A | 12/1943 | Crawford | |
| 3,266,784 | A | 8/1966 | Saito | |
| 3,350,892 | A | 11/1967 | Kelley | |
| 4,691,530 | A | 9/1987 | Meckler | |
| 4,955,205 | A * | 9/1990 | Wilkinson | 62/94 |
| 5,070,703 | A | 12/1991 | Wilkinson | |
| 5,191,771 | A | 3/1993 | Meckler | |
| 5,988,843 | A * | 11/1999 | Handel | 362/576 |
| 6,018,954 | A | 2/2000 | Assaf | |
| 6,494,053 | B1 * | 12/2002 | Forkosh et al. | 62/271 |

FOREIGN PATENT DOCUMENTS

| | | |
|---|---|---|
| WO | WO 99/26025 | 5/1999 |
| WO | WO 99/26026 | 5/1999 |
| WO | WO 00/55546 | 9/2000 |
| WO | WO 02/66901 | 8/2002 |
| WO | WO 02/86391 | 10/2002 |
| WO | WO 03/056249 | 7/2003 |

OTHER PUBLICATIONS

Yonemoto, K.; JP 11-132505; May 21, 1999 & Patent Abstracts of Japan; vol. 1999; No. 10; Aug. 31, 1999.

* cited by examiner

*Primary Examiner* — Cheryl J Tyler
*Assistant Examiner* — Lakiya Rogers
(74) *Attorney, Agent, or Firm* — Brooks Kushman P.C.

(57) ABSTRACT

An air-conditioning system for conditioning air by removing heat and moisture from the air and transferring it to the environment, comprising: a dehumidifier (14) that produces dehumidified air and utilizes a liquid desiccant for drying; at least one non-desiccant fluid at a temperature lower than the temperature of the liquid desiccant; and at least one heat exchanger (20) in which the liquid desiccant is cooled by the at least one fluid.

30 Claims, 5 Drawing Sheets

HIGH EFFICIENCY DEHUMIDIFIERS AND COMBINE DEHUMIDIFYING/AIR-CONDITIONING SYSTEMS

RELATED APPLICATIONS

The present application is a U.S. national application of PCT Application No. PCT/IL01/01207, filed on Dec. 27, 2001.

FIELD OF THE INVENTION

The present invention is related to the field of environmental control systems and more particularly, to the field of dehumidifiers, and systems which combine dehumidification and air conditioning.

BACKGROUND OF THE INVENTION

There have been two general approaches to the design of systems that combine air conditioning and dehumidification. In one approach, the air is cooled down to the dew point for the desired final moisture content, in order to remove all undesired moisture. Because this dew point is generally below the desired final air temperature, the air at this dew point must then be heated, usually by mixing it with air that is already in the room being air conditioned.

In the second approach, the air is dehumidified, before cooling it, by exposing it to a desiccant, which absorbs moisture from the air. If the absorption of moisture by the desiccant takes place without any heat flow, i.e. at constant enthalpy, then the air will become hotter as it is dehumidified. The air must then be cooled even more than if it had remained at the outside temperature, which also lowers the efficiency of the air conditioner.

For this reason, it is generally considered to be desirable to remove heat from the desiccant while it is absorbing moisture. In a dehumidifier described in U.S. Pat. No. 6,018,954, a heat pump is used to remove heat from the desiccant while it is absorbing moisture, and to transfer the heat to a regenerator where the desiccant gives off moisture so that it can be used again.

In any dehumidifier using a desiccant, it is desirable to expose a large surface area of desiccant to the incoming air, in order to maximize the throughput of air that can be dehumidified. In the case of liquid desiccant, a large surface area has been produced by spraying small droplets of desiccant through the air, and by dripping the desiccant onto a sponge. Because the desiccant quickly becomes saturated with moisture if it has a large surface area, in all of these dehumidifiers there is a reservoir of desiccant which does not have a large surface area. When the dehumidifier is operating, the desiccant is continuously drawn from the reservoir, a small quantity of the desiccant is exposed to the air in a form with a large surface area (droplets, or sponge, for example) and it is then returned to the reservoir. Dehumidifiers using a reservoir in this way are described in U.S. Pat. No. 6,018,954, and in PCT patent publications WO 99/26025 and WO 99/26026, the disclosures of which are incorporated herein by reference. On a slower time scale, as the absorbed moisture builds up in the reservoir, the desiccant in the dehumidifier reservoir is circulated into a regenerator, where the moisture is removed from the desiccant by heating it, and the desiccant is circulated back into the dehumidifier reservoir. Within the regenerator, desiccant is also drawn from a reservoir and a small quantity is exposed to the air in a form with a large surface area, for example droplets or a sponge, to speed up the rate at which the moisture is removed from the desiccant.

Modern room air conditioners generally use mechanical heat pumps to cool the air, which requires a large power input. A more energy efficient method of cooling air, known since ancient times, is to use a fan to blow the air past evaporating water. This method consumes much less energy than a heat pump, because it makes use of the free energy inherent in ambient air at less than 100% humidity. By comparison with this free energy, the energy consumed by the fan is trivial. The disadvantages of evaporative cooling are that the air that is cooled has a higher moisture content than the ambient air, and the method doesn't work well at high ambient humidity. Nevertheless, evaporative cooling is often used to cool open environments, for example stockyards, where low humidity is not so important, ambient humidity is not too high, and low power consumption is important. Evaporation of water has also been used to cool the refrigerant in heat pumps used in many cooling systems, and (as described in U.S. Pat. No. 6,018,954) to cool the refrigerant used in a heat pump used for cooling the desiccant in a dehumidifier and heating the desiccant in the associated regenerator.

SUMMARY OF INVENTION

An aspect of some embodiments of the invention relates to dehumidifiers with a dehumidifying section, where liquid desiccant removes moisture from the air being dehumidified, and a regenerating section, where moisture is removed from liquid desiccant, generally by using heat to evaporate the moisture into the air, and the moist air is returned to the outside environment. In these embodiments, in one or both of these sections, one or more moving elements containing liquid desiccant are exposed to the air, and repeatedly dip into and out of a reservoir of liquid desiccant, replacing the desiccant they are holding with desiccant from the reservoir. In the case of the dehumidifying section, as the desiccant on the moving elements becomes saturated with moisture, it is replaced with fresh desiccant from the reservoir. In the case of the regenerating section, as the desiccant on the moving elements loses its moisture to the air, it is replaced by desiccant from the reservoir which still needs to have moisture removed from it.

Optionally, the elements comprise an absorbent material such felt or sponge attached to a surface. Alternatively, the elements comprise one or more cups or other holders for the desiccant. Alternatively or additionally, the desiccant sticks to a nonabsorbent surface of the elements due to its viscosity or surface tension.

Optionally, the elements are mounted on the blades of a propeller or windmill, which is caused to turn by the incoming air current, and the blades dip in and out of the reservoir as the windmill turns. This design has the advantage that if the air streaming into the dehumidifier speeds up or slows down, and the desiccant consequently gets saturated more quickly or less quickly, then the moisture laden desiccant is automatically replaced more quickly or less quickly, corresponding to the replacement rate that is needed.

Alternatively, the elements are on a conveyor belt mounted on a turning wheel, which belt continuously passes into and out of the reservoir as the wheel turns.

Alternatively, each element undergoes a linear reciprocating motion, dipping into and out of the reservoir. Optionally, the changing weight of the desiccant when it becomes moisture laden (in the case of the dehumidifying section) or loses its moisture (in the case of the regenerating section) triggers the element to dip into the reservoir.

Optionally, the dipping motion of the elements, whether linear or rotary, intermittent or continuous, is driven by a motor. Optionally, the motor is powered by a battery or a solar cell. Alternatively, the dipping motion is driven by the same motor that drives an air intake fan, drawing outside air into the dehumidifier. Unless the dipping motion is only intermittent, or the air intake fan is very big and slow, the air intake fan may turn faster than the rate of the dipping motion required for replacing the desiccant. Optionally, a set of gears is used to reduce the speed of the dipping motion to an appropriate speed for replacing the desiccant. Optionally, the same motor drives the elements in the dehumidifying section and in the regenerating section.

It is important not to confuse this aspect of the invention with a well known prior art, in which a wheel is used to move desiccant (usually solid desiccant) from a dehumidifying section, where the desiccant absorbs moisture from the air, to a regenerating section, where the desiccant is heated and gives up its moisture, and back to the dehumidifying section. In the present invention, the elements do not move desiccant between the dehumidifying section and the regenerating section, but between the reservoir and the air within the dehumidifying section or between the reservoir and the air within the regenerating section. In addition to this motion, moisture is transferred by other means from the reservoir associated with the dehumidifying section to the reservoir associated with the regenerating section. Optionally this is done by pumping, gravity, diffusion, any combination of these, or any other means known to the art. For example, it is optionally done by a combination of gravity and diffusion, as described in unpublished PCT Applications PCT/IL01/00373 and PCT/IL01/00374, the disclosures of which are incorporated herein by reference.

Using a wheel, belt, or similar mechanical system to circulate desiccant out of and into the reservoir has some advantages over the prior art of spraying, dripping, or wicking the desiccant from the reservoir. Wicking, as described in unpublished PCT Application PCT/IL01/00374, is slower than the other methods, since the dehumidification rate or regenerating rate is limited by the speed at which water flows down the wick into the reservoir in the dehumidifying section, and up the wick from the reservoir in the regenerating section. Dripping requires some power to lift the desiccant up to the point where it is dripped, and requires special pumps to pump the (generally corrosive) desiccant.

With a wheel or belt, on the other hand, if the desiccant is absorbed into an absorbent material using capillary action, then, in principle, no power is needed to move the desiccant into and out of the reservoir in the dehumidifying area, since the weight of the moisture-laden desiccant traveling down into the reservoir is greater than the weight of the fresh desiccant being lifted out of the reservoir. If friction and drag are kept low enough, the potential energy gained by lowering the moisture from the air into the reservoir could be used to overcome the friction and drag, and the wheel or belt could operate with no external power. Such a self-powered wheel or belt is not possible in the regenerating section. In general, in the dehumidifying section or regenerating section, a belt or wheel can be driven by a relatively low power motor, or, in the case of a wheel driven like a windmill, a relatively small amount of extra power needs to be put into the air flow by the intake fan.

Neither dripping nor spraying provides a simple feedback system for controlling the rate at which desiccant is circulated, although more elaborate feedback systems involving sensors and controllers are possible. With a wheel driven like a windmill by the incoming air stream, there is a natural relation between the rate of circulation of desiccant into and out of the reservoir, and the rate at which desiccant become saturated with moisture in the dehumidifying area, or free of moisture in the regenerating area, and needs to be replaced by desiccant from the reservoir.

A second aspect of some embodiments of the invention concerns a combined dehumidifying/air-conditioning system, in which water and air, at less than 100% humidity, are cooled off by allowing the water to evaporate into said air, and the resulting cooled water and/or cooled but humid air is used to cool desiccant that is being used to absorb moisture in the dehumidifier, by heat exchange. Without cooling, the desiccant would get hotter than the ambient air as it absorbed moisture from the air, due to the heat of vaporization of the moisture. Alternatively or additionally, any other source of water, air, or another fluid, or any combination of these, even at or above the ambient temperature, is used to cool the desiccant. Alternatively or additionally, water and air are cooled off by letting the water evaporate into said air, and the resulting cooled water and/or cooled but humid air are used to cool warm dehumidified air, by heat exchange. Optionally, the air into which the water is evaporated is also warm dehumidified air. Alternatively, the air into which the water is evaporated is ambient air, if the ambient humidity is not too high, or a mixture of dehumidified air and ambient air.

The cooling that is accomplished in this way requires much less power than if a heat pump were used. If the water is evaporated into ambient air, then the cooling is essentially cost free, since it makes use of the internal energy associated with the fact that the ambient air has humidity less than 100%. The power needed to overcome pipe losses and pump the cool water and/or air through the heat exchanger can be quite small, compared to the power that would be needed to cool the desiccant or the warm dehumidified air using a heat pump. If the water is evaporated into air that has been dehumidified, then some of the internal energy comes, ultimately, from the heat that is used to regenerate the desiccant that did the dehumidifying. If the dehumidifier uses a source of waste heat to regenerate the desiccant, then that energy is essentially cost-free as well.

Although prior art systems using evaporation for cooling share this feature of low power requirements, they introduce into the air-conditioned environment air that has higher moisture content than the ambient air. In some embodiments of the invention, the moist cooled air is not released into the air-conditioned environment, but is only used in heat exchangers to cool other air directly (or indirectly by cooling desiccant), and then released into the ambient environment. Thus, the advantage of low power requirements can be obtained, without the disadvantage of introducing moist air into the air-conditioned environment.

There is thus provided, in accordance with an embodiment of the invention, an air-conditioning system for conditioning air by removing heat and moisture from the air and transferring it to the environment, comprising:

a dehumidifier that produces dehumidified air and utilizes a liquid desiccant for drying;

at least one non-desiccant fluid at a temperature lower than the temperature of the liquid desiccant; and at least one heat exchanger in which the liquid desiccant is cooled by the at least one fluid.

In a embodiment of the invention, at least one of the at least one fluids comprises water.

Alternatively or additionally, at least one of the at least one fluids comprises air.

In an embodiment of the invention, there is at least one cooling chamber through which air flows, and which contains water which evaporates into said air, wherein the at least one fluid comprises one or both of air exiting at least one of the at least one cooling chambers and water cooled in at least one of the at least one cooling chambers.

Optionally, the water in at least one of the at least one cooling chambers is sprayed into the air in said cooling chamber.

Optionally, at least some of the air flowing through at least one of the at least one cooling chambers comprises at least some of the dehumidified air produced by the dehumidifier.

Alternatively or additionally, at least some of the air flowing through at least one of the at least one cooling chambers comprises air that has not been dehumidified by the dehumidifier.

Optionally, at least one of the at least one heat exchangers is in thermal contact with at least one of the at least one cooling chambers.

Optionally, there is a desiccant pump which pumps the desiccant through at least one of the at least one heat exchangers.

Alternatively there is a desiccant reservoir, the liquid desiccant utilized by the dehumidifier is contained at least part of the time in the desiccant reservoir, and at least one of the at least one heat exchangers is in thermal contact with the desiccant reservoir.

There is further provided, in accordance with an embodiment of the invention, an air-conditioning system for conditioning air by removing heat and moisture from the air and transferring it to the environment, comprising:

a dehumidifier which produces dehumidified air;

at least one cooling chamber through which air flows, and which contains water which evaporates into said air; and at least one heat exchanger in which at least some of the dehumidified air is cooled by one or both of air exiting at least one of the at least one cooling chambers or water cooled in at least one of the at least one cooling chambers.

In an embodiment of the invention, the dehumidifier utilizes a liquid desiccant for drying, and the liquid desiccant is cooled in at least one of the at least one heat exchangers by one or both of air exiting at least one of the at least one cooling chambers or water cooled in at least one of the at least one cooling chambers.

Optionally, the at least one heat exchangers comprise a first heat exchanger in which the liquid desiccant is cooled, and a second heat exchanger in which at least some of the dehumidified air is cooled.

Optionally, the at least one cooling chambers comprise a first cooling chamber and a second cooling chamber, wherein one or both of the air exiting from the first cooling chamber or the water cooled in the first cooling chamber is used to cool the liquid desiccant, and one or both of the air exiting from the second cooling chamber or the water cooled in the second cooling chamber is used to cool at least some of the dehumidified air.

Optionally, air exiting at least one of the at least one cooling chambers is used to cool the liquid desiccant.

Alternatively or additionally, water cooled in at least one of the at least one cooling chambers is used to cool the liquid desiccant.

Optionally, there is a desiccant pump which pumps the desiccant through at least one of the at least one heat exchangers.

Alternatively, there is a desiccant reservoir, the liquid desiccant utilized by the dehumidifier is contained at least part of the time in the desiccant reservoir, and at least one of the at least one heat exchangers is in thermal contact with the desiccant reservoir.

Optionally, the water in at least one of the at least one cooling chambers is sprayed into the air in said cooling chamber.

Optionally, at least some of the air flowing through at least one of the at least one cooling chambers comprises at least some of the dehumidified air produced by the dehumidifier.

Alternatively or additionally, at least some of the air flowing through at least one of the at least one cooling chambers comprises air that has not been dehumidified by the dehumidifier.

In an embodiment of the invention, the air exiting at least one of the at least one cooling chambers is used to cool the dehumidified air.

Alternatively or additionally, water cooled in at least one of the at least one cooling chambers is used to cool the dehumidified air.

Optionally, at least one of the at least one heat exchangers is in thermal contact with at least one of the at least one cooling chambers.

There is further provided, in accordance with an embodiment of the invention, a dehumidifier for removing moisture from air to be dried and transferring it to environmental air, comprising:

liquid desiccant;

a dehumidifying section;

a dehumidifying section reservoir containing at least some of the liquid desiccant; and at least one dehumidifying section element;

wherein each dehumidifying section element moves from the dehumidifying section reservoir to the dehumidifying section, carrying some of the desiccant from the dehumidifying section reservoir with it, which desiccant absorbs moisture from the air to be dried in the dehumidifying section, and the said dehumidifying section element then moves back to the dehumidifying section reservoir, carrying the desiccant back to the dehumidifying section reservoir.

There is further provided, in accordance with an embodiment of the invention, a dehumidifier for removing moisture from air to be dried and transferring it to environmental air, comprising:

liquid desiccant;

a dehumidifying section where the liquid desiccant removes moisture from the air;

a regenerating section;

a regenerating section reservoir containing at least some of the liquid desiccant; and at least one regenerating section element;

wherein each regenerating section element moves from the regenerating section reservoir to the regenerating section, carrying some of the desiccant from the regenerating section reservoir with it, which desiccant gives up moisture to the environmental air in the regenerating section, and the said regenerating section element then moves back to the regenerating section reservoir, carrying the desiccant back to the regenerating section reservoir.

Optionally, at least one dehumidifying section elements moves continuously.

Alternatively or additionally, at least one of the at least one dehumidifying section elements moves intermittently.

In an embodiment of the invention, the rate at which the desiccant carried by at least one of the at least one dehumidifying section elements is replaced by desiccant from the dehumidifying section reservoir depends on the rate at which the desiccant carried by said dehumidifying section element absorbs moisture from the air to be dried.

Optionally, there is a sensor which senses the amount of moisture absorbed by the desiccant in at least one of the at least one dehumidifying section elements, and a controller which causes said dehumidifying section element to move or to move faster when the absorbed moisture exceeds a given level.

Optionally, the air to be dried moves through the dehumidifying section, and said motion of the air to be dried causes or contributes to causing at least one of the at least one dehumidifying section elements to move.

Alternatively or additionally, there is a motor operative to move at least one of the at least one dehumidifying section elements.

In an embodiment of the invention, there is at least one wheel which comprises at least one of the at least one dehumidifying section elements, and a rotating of the wheel comprises the moving of at least one of the at least one dehumidifying section elements that said wheel comprises.

Alternatively or additionally, there is at least one conveyor belt which comprises at least one of the at least one dehumidifying section elements, and a conveying of the belt comprises the moving of at least one of the at least one dehumidifying section elements that said belt comprises.

Optionally, at least one of the at least one dehumidifying section elements comprises absorbent material.

Alternatively or additionally, the desiccant adheres to at least one of the at least one dehumidifying section elements because of viscosity or surface tension.

Alternatively or additionally, at least one of the at least one dehumidifying section elements comprises at least one hollow space, and the desiccant remains in said space for at least a portion of the movement of the element.

Optionally, there is a dehumidifying section desiccant remover which removes desiccant from at least one of the at least one dehumidifying section elements, after said desiccant has absorbed moisture from the air to be dried in the dehumidifying section, and before said element carries desiccant from the dehumidifying section reservoir to the dehumidifying section for a further drying cycle.

Optionally, the removal of desiccant from at least one of the at least one dehumidifying section elements is done by any one or a combination of squeezing, scraping, wiping, and siphoning the said dehumidifying section element.

Alternatively or additionally, the removal of desiccant from at least one of the at least one dehumidifying section elements is done by tipping the said dehumidifying section element.

Optionally, at least one of the at least one regenerating section elements moves continuously.

Alternatively or additionally, at least one of the at least one regenerating section elements moves intermittently.

In an embodiment of the invention, the rate at which the desiccant carried by at least one of the at least one regenerating section elements is replaced by desiccant from the regenerating section reservoir depends on the rate at which the desiccant carried by said regenerating section element gives up moisture to the environmental air in the regenerating section.

Optionally, there is a sensor which senses the amount of moisture absorbed by the desiccant in at least one of the at least one regenerating section elements, and a controller which causes said regenerating section element to move or to move faster when the absorbed moisture falls below a given level.

Optionally, the environmental air moves through the regenerating section, and said motion of the environmental air causes or contributes to causing at least one of the at least one regenerating section elements to move.

Additionally or alternatively, there is a motor operative to move at least one of the at least one regenerating section elements.

Optionally, there is at least one wheel which comprises at least one of the at least one regenerating section elements, and a rotating of the wheel comprises the moving of at least one of the at least one regenerating section elements that said wheel comprises.

Alternatively or additionally, there is at least one conveyor belt which comprises at least one of the at least one regenerating section elements, and a conveying of the belt comprises the moving of at least one of the at least one regenerating section elements that said belt comprises.

Optionally, at least one of the at least one regenerating section elements comprises absorbent material.

Alternatively or additionally, the desiccant adheres to at least one of the at least one regenerating section elements because of viscosity and/or surface tension.

Alternatively or additionally, at least one of the at least one regenerating section elements comprises at least one hollow space, and wherein the desiccant remains in said space for at least a portion of the movement of the element.

In an embodiment of the invention, there is a regenerating section desiccant remover which removes desiccant from at least one of the at least one regenerating section elements, after said desiccant has given up moisture to the environmental air in the regenerating section, and before said element carries desiccant from the regenerating section reservoir to the regenerating section for a further regenerating cycle.

Optionally, the removal of desiccant from at least one of the at least one regenerating section elements is done by any one or a combination of squeezing, scraping, wiping, and siphoning the said regenerating section element.

Alternatively or additionally, the removal of desiccant from at least one of the at least one regenerating section elements is done by tipping the said regenerating section element.

BRIEF DESCRIPTION OF THE DRAWINGS

Exemplary embodiments of the invention are described in the following sections with reference to the drawings. The drawings are generally not to scale and the same or similar reference numbers are used for the same or related features on different drawings.

DETAILED DESCRIPTION OF EXEMPLARY EMBODIMENTS

Figure 1:
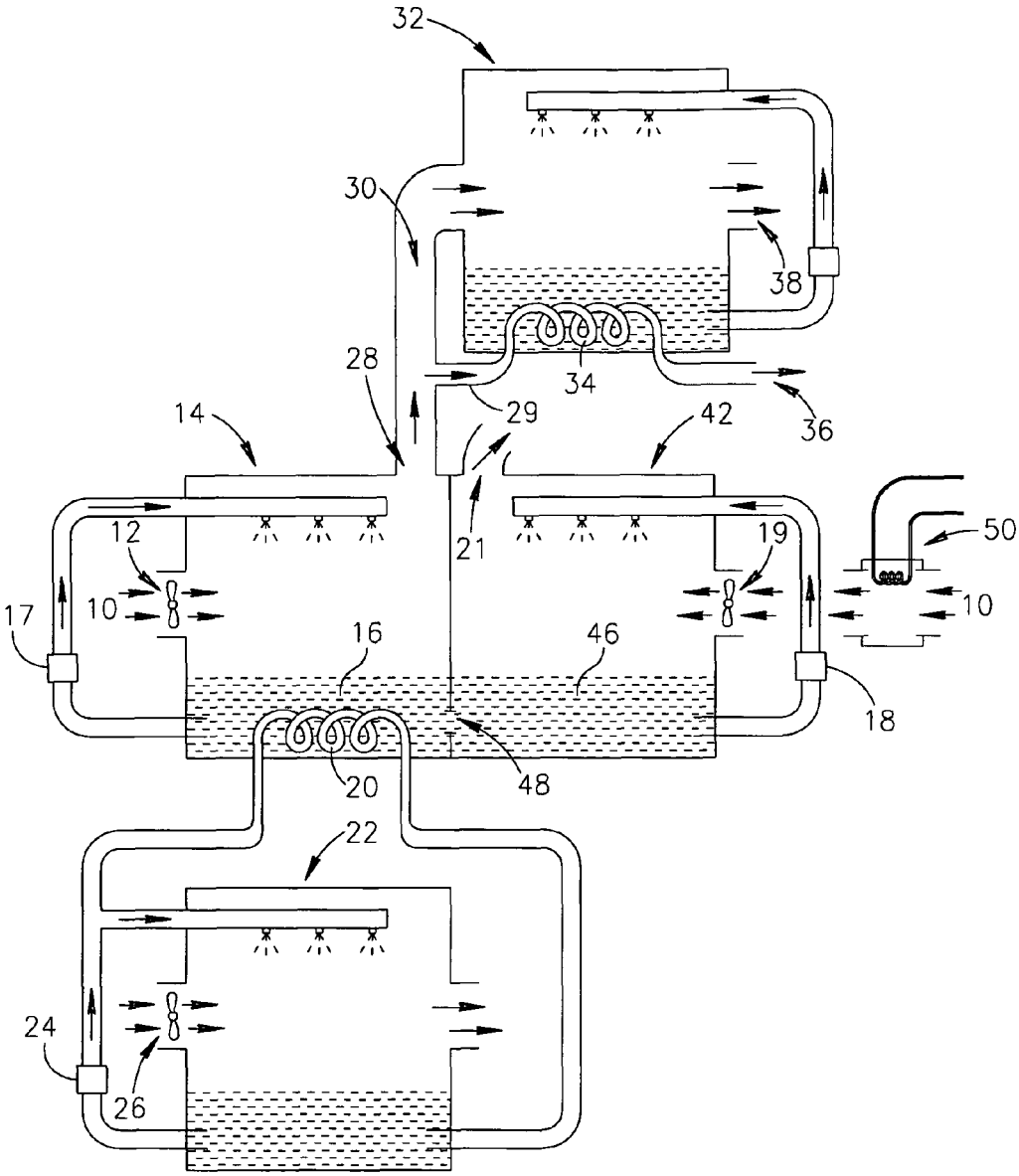
FIGS. 1 and 4 schematically show combined dehumidifying/air-conditioning systems, according to some embodiments of the invention.

FIG. 1 schematically shows a combined dehumidifying/air-conditioning system, according to an exemplary embodiment of the invention. Warm and humid air 10 is drawn by an intake fan 12 into a dehumidifying chamber 14 which is associated with a reservoir 16 filled with liquid desiccant. Optionally, the dehumidifier uses a rotating wheel or belt or similar mechanism (not shown in FIG. 1), to circulate desiccant out of and into reservoir 16, as will be described in detail in FIG. 3, exposing the desiccant to the air and allowing the desiccant to absorb moisture from the air. Alternatively, the dehumidifier uses a prior art method of exposing the desiccant to the air, such as spraying, dripping, or wicking the desiccant. FIG. 1 shows a pump 17, which draws the desiccant out of reservoir 16, and drips or sprays it through the air. A regenerating chamber 42, adjacent to the dehumidifying chamber, has its own reservoir 46 of liquid desiccant, and its own pump 18, which draws desiccant out of reservoir 46 and drips or sprays it through the air in regenerating chamber 42. Alternatively, the regenerating chamber uses another method of exposing the desiccant to the air, for example wicking, or using a rotating wheel, belt or similar mechanism as described in FIG. 3. The regenerating chamber has its own intake fan 19 which draws ambient air into the regenerating chamber. Alternatively, a single fan, and an intake duct that splits into two parts, is used to draw ambient air into both the dehumidifying chamber and the regenerating chamber.

A heater 50 heats the air flowing into regenerating chamber 42, lowering the humidity of the air. Optionally, the heater is a heat exchanger, which uses a source of waste heat, generally available in large buildings. Alternatively or additionally, the heater is an electric heater, or any other kind of heater known to the art. Optionally, heater 50, or another heater, heats the desiccant in reservoir 46 or elsewhere in regenerating chamber 42, in addition to or instead of heating the air flowing into regenerating chamber 42. Sufficiently heating the desiccant in regenerating chamber 42 and/or lowering the humidity of the air in regenerating chamber 42 will make the desiccant give up moisture to the air, instead of absorbing moisture from the air as occurs in dehumidifying chamber 14. The moist air in regenerating chamber 42 is returned to the outside environment through an exit duct 21.

In an embodiment of the invention, there is at least one small hole 48 between reservoir 16 and reservoir 46. As described in unpublished PCT Applications PCT/IL01/00373 and PCT/IL01/00374, a combination of gravity and diffusion causes moisture to move from reservoir 16 through hole 48 to reservoir 46, without the need to actively move desiccant between the reservoirs. As the desiccant in the dehumidifying section absorbs water from the air, the volume of desiccant in reservoir 16 increases. At the same time, as the desiccant in the regenerating section gives up moisture to the air, the volume of desiccant in reservoir 46 decreases. Gravity causes moisture laden desiccant from reservoir 16 to flow through hole 48 into reservoir 46, to keep the two reservoirs at nearly the same level. In equilibrium, there is a net flow of water from reservoir 16 to reservoir 46, and there is a counter flow of desiccant ions diffusing through hole 48 from reservoir 46 to reservoir 16, to balance the gravity assisted flow of desiccant ions going the other direction, resulting in a net zero flow of desiccant ions. This method of transferring moisture and circulating the desiccant between the two reservoirs avoids unnecessary transfer of heat from reservoir 46 to reservoir 16. Alternatively or additionally, desiccant is pumped from reservoir 16 to reservoir 46 and back, in order to remove moisture from it, as in the art prior to PCT/IL01/00373. Such pumping is optionally used, for example, in order to increase the rate at which moisture flows from reservoir 16 to reservoir 46, in order to improve the effectiveness of the dehumidification, even at the cost of decreasing the effectiveness or efficiency of the cooling. Optionally, desiccant is pumped in one direction, and made to flow in the other direction by gravity.

Figure 4:
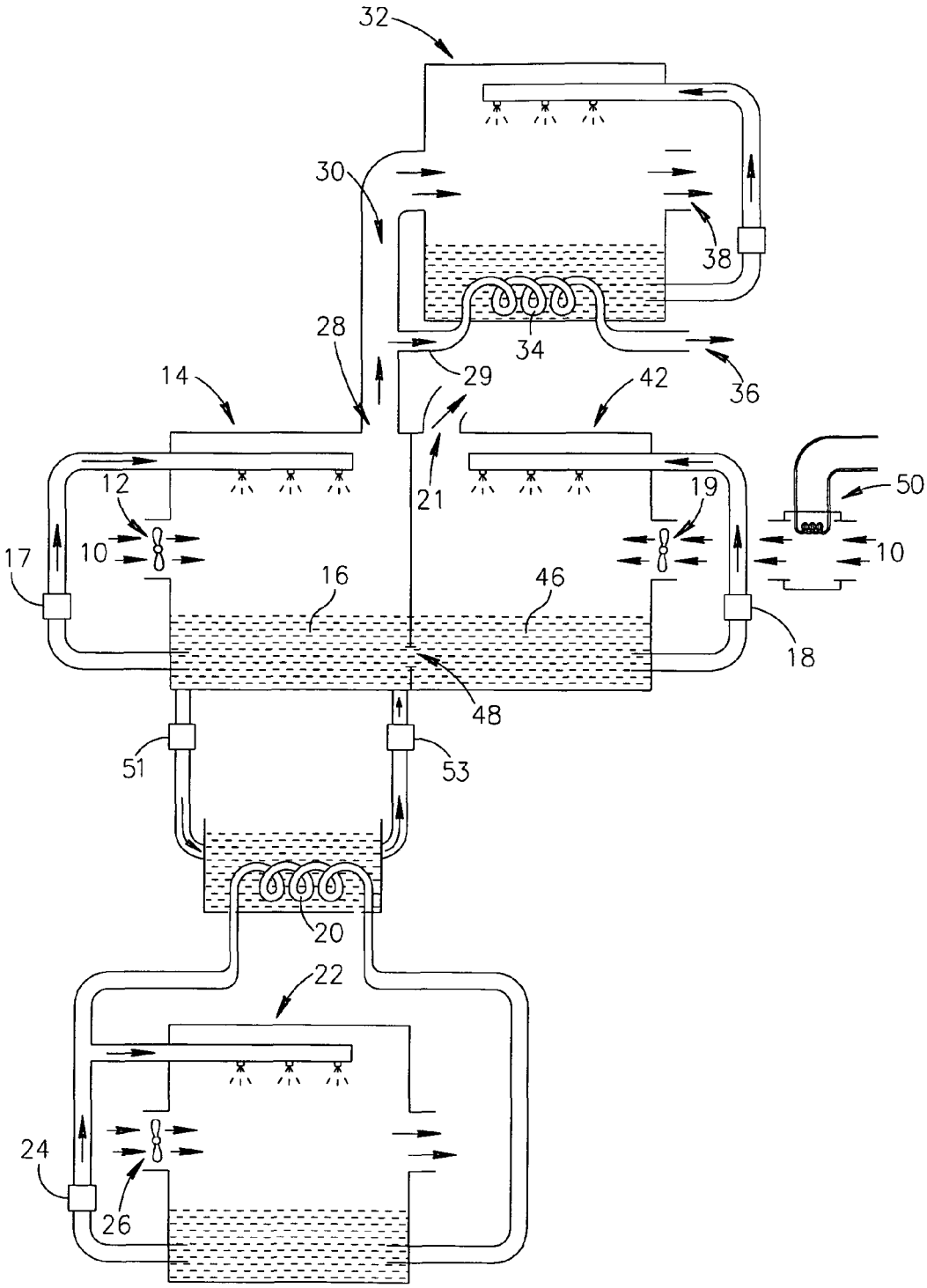

A heat exchanger 20 is located in reservoir 16, and the desiccant in reservoir 16 is cooled by water that is pumped through the heat exchanger from a cooling chamber 22, by a pump 24. Alternatively, heat exchanger 20 is located in cooling chamber 22 and the desiccant is pumped, optionally by pump 17, from reservoir 16 through the heat exchanger and back to reservoir 16. Alternatively, heat exchanger 20 is located outside both reservoir 16 and cooling chamber 22, and both water from cooling chamber 22 and desiccant from reservoir 16 are pumped through heat exchanger 20 and back. For example, as shown in FIG. 4, pumps 51 and 53 pump the desiccant trough heat exchanger 20 and back.

In cooling chamber 22, the water is cooled below the ambient air temperature by allowing the water to evaporate into ambient air drawn into and through the cooling chamber by fan 26. Optionally, the water is sprayed through the air in cooling chamber 22 to facilitate evaporation, optionally using pump 24 as shown in FIG. 1, or any other means known to the art is used to facilitate evaporation. The air is also cooled by this process, and alternatively the cooled air is used, instead of or in addition to the cooled water, to cool the desiccant in heat exchanger 20. This cooling of the desiccant in heat exchanger 20 prevents the desiccant from heating up as much as it would if the dehumidification in dehumidifying chamber 14 occurred at constant enthalpy, and optionally the equilibrium temperature of the desiccant is even below the ambient temperature of the air. The cooled desiccant in turn keeps the dehumidified air leaving chamber 14 at a lower temperature than if it would have if it were dehumidified at constant enthalpy, and optionally even cools it below the ambient temperature.

Instead of or in addition to using water and/or air cooled in cooling chamber 22 to cool the desiccant, heat exchanger 20 optionally uses any other source of water and/or air, or any other fluid, to cool the desiccant, even water or air that is at or above the ambient temperature. As long as the water or air used in heat exchanger 20 has a lower temperature than the temperature that the desiccant would reach if it absorbed the moisture at constant enthalpy, heat exchanger 20 will still cool the desiccant.

In some embodiments of the invention, the dehumidified air flows out of chamber 14 through a duct 28, which splits into two parts. Part of the air flows through a duct 29, and part of the air flows through a duct 30 into a second cooling chamber 32, where water evaporates into it, optionally facilitated by spraying the water through said air, or by any other means known to the art. Because the air entering cooling chamber 32 has lower humidity than the ambient air entering cooling chamber 22, and does not differ greatly in temperature from the ambient air, the air and water in chamber 32 are cooled by the evaporation to an even lower temperature than the air and water in chamber 22. Some or all of the cooled water from chamber 32 is used to cool the air flowing through duct 29, in a heat exchanger 34. Alternatively or additionally, the cooled air from chamber 32 is used in heat exchanger 34 to cool the air flowing through duct 29. Optionally, heat exchanger 34 is located inside cooling chamber 32 and duct 29 passes through cooling chamber 32. Alternatively, heat exchanger 34 is located outside cooling chamber 32, adjacent to duct 29, and water and/or air from cooling chamber 32 is pumped or made to flow into heat exchanger 34. The air from duct 29 does not mix with the moist air or water from chamber 32, and is only cooled by it, so air from duct 29 remains dry after passing through heat exchanger 34. This dry, cool air is used for output air 36 from the air conditioner. Air 38 that has passed through chamber 32 is not used as output air from the air conditioner, because it has high humidity, so it is vented to the outside.

Optionally, dehumidified air from duct 28, or a mixture of dehumidified air and ambient air, is used in cooling chamber 22, instead of ambient air. Optionally, ambient air, or a mixture of dehumidified air and ambient air, is used cooling chamber 32, instead of dehumidified air. Optionally, instead of two cooling chambers 22 and 32, there is only one cooling chamber, and it used both for cooling desiccant in the dehumidifying section, and for cooling dehumidified air exiting the dehumidifying section through duct 28.

Figure 2:
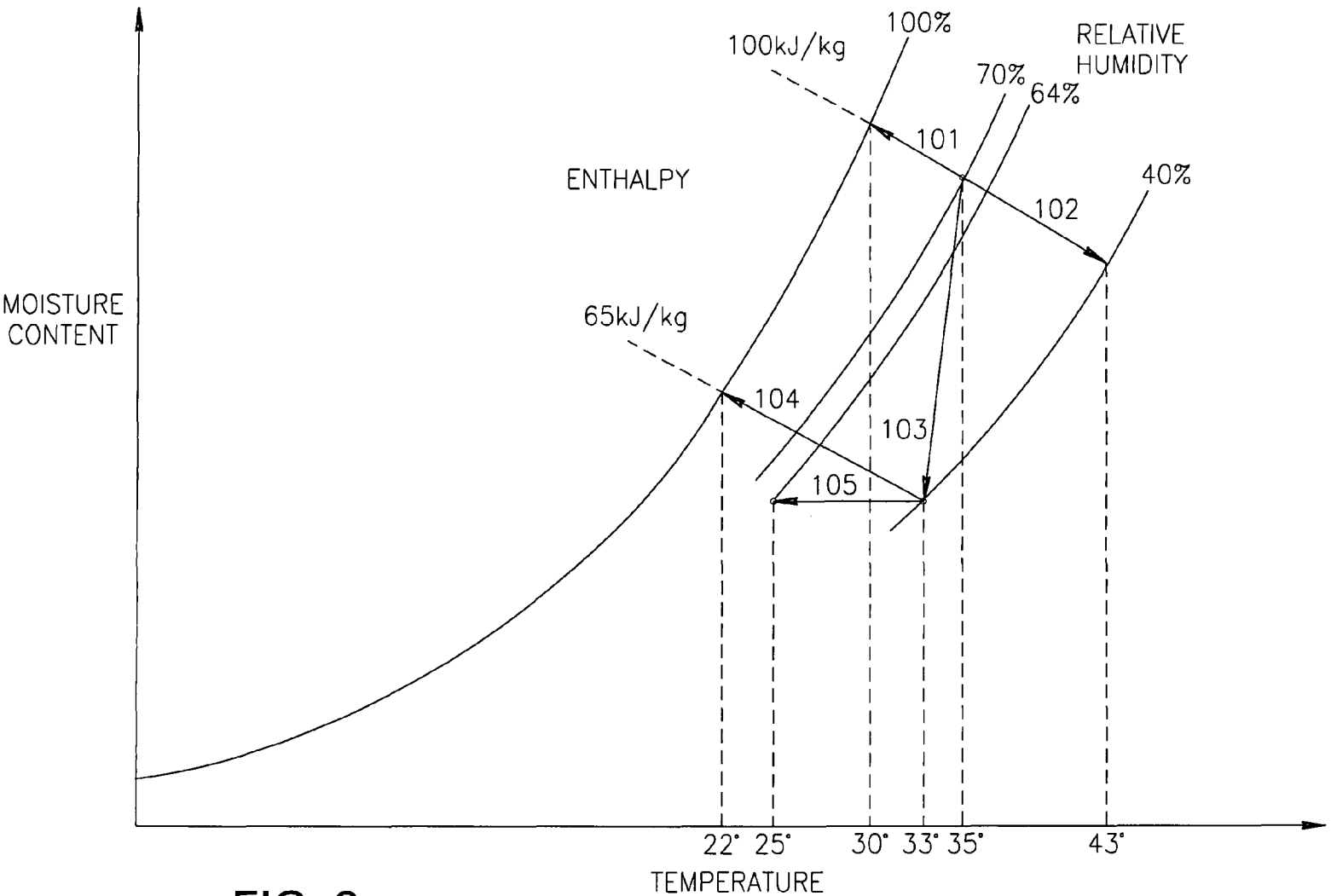
FIG. 2 is a plot of temperature vs. moisture content for air at sea level, showing the paths taken by air at different stages of the cooling and dehumidifying process in the apparatus shown in FIG. 1.

FIG. 2 is a chart showing curves of constant relative humidity and constant enthalpy, as a function of temperature and moisture content, for air at sea level. If the ambient air is at 35 degrees C. and 70% humidity, then, if the water in chamber 22 is allowed to evaporate into the ambient air at constant enthalpy until it reaches 100% humidity (path 101 in FIG. 2), its temperature will fall to 30 degrees C. This is the lowest temperature that the water in chamber 22 can reach by constantly evaporating it into ambient air, and by thermally insulating it from the outside environment. If the ambient air entering dehumidifying chamber 14 were allowed reach a humidity of 40% at constant enthalpy (path 102), it would have a temperature of 43 degrees C., and (ignoring the additional heating of the desiccant in the regenerator chamber) the desiccant would reach an equilibrium temperature of 43 degrees C. if it were thermally insulated from the outside. By using the water from chamber 22 to cool the desiccant as it is reducing the humidity of the air from 70% to 40%, the equilibrium temperature of the desiccant can be brought to a point somewhere between 43 degrees and 30 degrees, and the air flowing out of chamber 14 through duct 28 can be brought to the same temperature. For example (path 103), this temperature can be 33 degrees.

The air flowing through duct 30, which starts at 33 degrees and 40% humidity, will reach 22 degrees if water is evaporated into it at constant enthalpy until it reaches 100% humidity (path 104). So the air flowing through chamber 32, and the water in chamber 32, could reach a temperature as low as 22 degrees, if chamber 32 is thermally insulated from the ambient environment. The air flowing through duct 29, after exchanging heat with the air or water from chamber 32, will reach a temperature somewhere between 33 degrees (the initial temperature of the air from duct 29 as it flows into the heat exchanger) and 22 degrees (the temperature of the water or air coming from chamber 32). For example, it could end up at a temperature of 25 degrees (path 105). Its moisture content will remain the same as it was before entering heat exchanger 34, and its final humidity will be 64%.

Figure 3A:
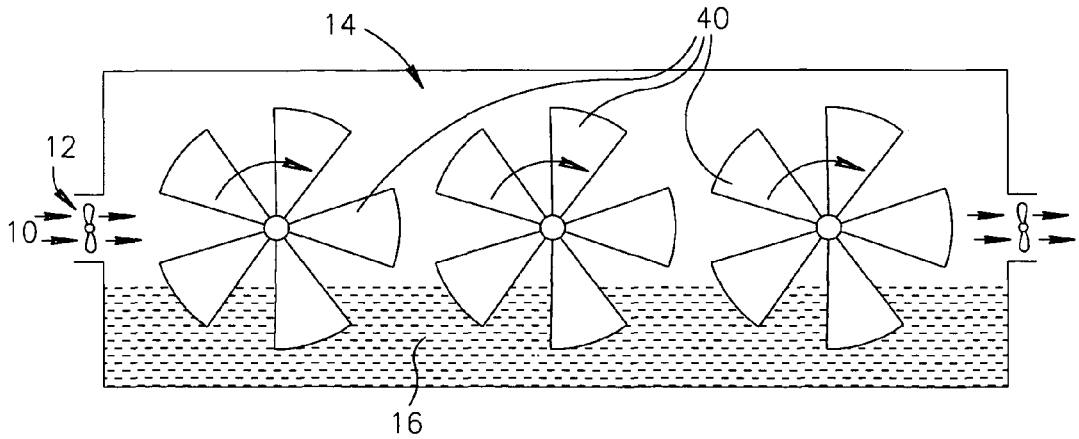
FIG. 3A and FIG. 3B show two different side views.
Figure 3B:
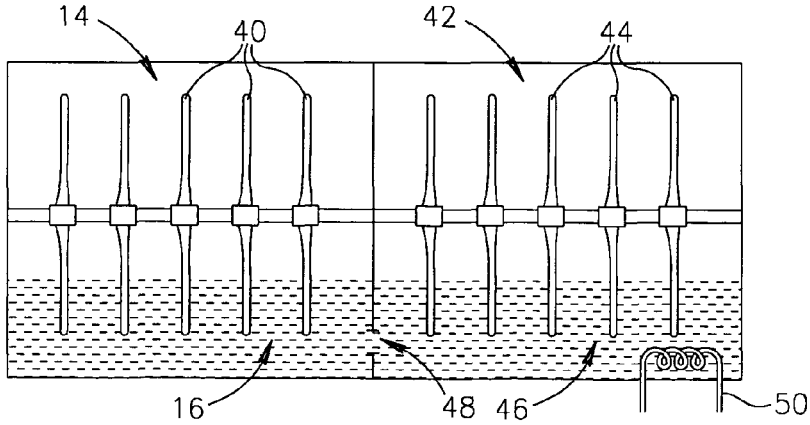
Figure 3C:
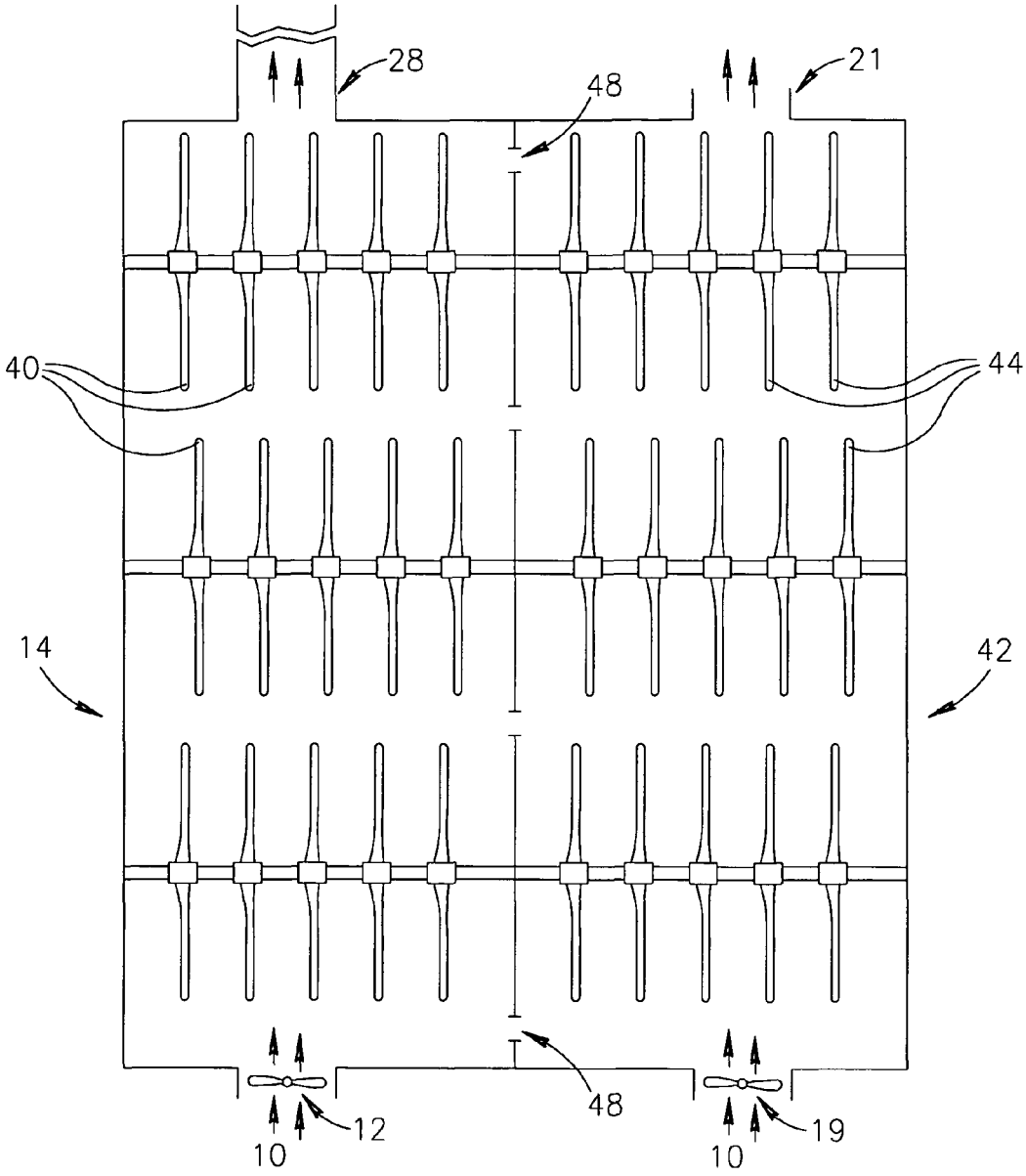
FIG. 3C shows a top view, of a dehumidifier, according to an embodiment of the invention.

FIGS. 3A, 3B and 3C show a dehumidifier, according to an embodiment of the invention. FIG. 3A is a view from one side, FIG. 3B is a view from another side, looking from the left in FIG. 3A, and FIG. 3C is a view from the top. Optionally, the dehumidifier shown in FIGS. 3A-3C is used as the dehumidifying component of a combined dehumidifying/air-conditioning system, such as that shown in FIG. 1. Alternatively, the dehumidifier shown in FIGS. 3A-3C is used as a stand alone dehumidifier.

In FIG. 3A, ambient air 10 is drawn by an intake fan 12 into a dehumidifying chamber 14, with a reservoir 16 of liquid desiccant at the bottom of the chamber. A windmill or a set of windmills 40 is mounted inside the chamber, so that the flowing air will cause them to turn. (each windmill shown in FIG. 3A optionally represents a row of several windmills, one behind the other on a common shaft, as may be seen in FIGS. 3B and 3C.) Alternatively or additionally, a motor supplies power to turn the windmills, possibly the same motor that drives the intake fan. Each windmill has several blades, covered with an absorbent material, for example felt or sponge. As the windmill turns, the blades successively dip into the reservoir, and the covering absorbs desiccant. The blade then goes through the air, where the desiccant absorbs moisture. When the blade returns to the reservoir, the moisture laden desiccant, or the moisture in the desiccant, diffuses into the reservoir, and the absorbent material contains desiccant with less moisture when the blade again surfaces and travels through the air. Optionally, the exchange of moisture laden desiccant for fresh desiccant may be aided by having the blades pass through a squeegee like device, or a device that presses against the blades on one side, before entering the reservoir, or while in the reservoir, although this may increase the force required to turn the windmill.

Eventually, the desiccant in the reservoir will become saturated with moisture unless moisture is removed. To prevent this from happening, moisture is removed from the desiccant in a regenerator. FIG. 3B shows a side cross sectional view of the dehumidifier, as seen from the direction of the air flow. Dehumidifying chamber 14, also seen in FIG. 3A, is on the left in FIG. 3B, and a regenerating chamber 42, not shown in FIG. 3A, is on the right in FIG. 3B. A wall 43 separates dehumidifying chamber 14 from regenerating chamber 42. Sets of windmills 44 are located in the regenerating chamber, similar to the windmills 40 in the dehumidifying chamber. A reservoir 46, filled with liquid desiccant, is located at the bottom of regenerating chamber 42, similar to reservoir 16 in dehumidifying chamber 14. Optionally wall 43, especially the part of wall 43 separating reservoir 16 from reservoir 46, is well insulated thermally. An intake duct with an intake fan 19, not shown in FIG. 3A or 3B but shown in FIG. 3C, located at one end of the regenerating chamber, for example next to intake fan 12, draws ambient air into regenerating chamber 42, and blows it past windmills 44.

At least one small hole 48 optionally connects dehumidifier reservoir 16 and regenerator reservoir 46, as described previously in the description of FIG. 1. Optionally there are several holes, lined up in the direction of the air flow, and/or one above the other. Alternatively or additionally, desiccant is pumped from dehumidifier reservoir 16 to regenerator reservoir 46 and pumped back, pumped in one direction and caused to flow in the other direction by gravity, or caused to circulate between reservoir 16 and reservoir 46 by any other method known to the art. Optionally, reservoir 16 and reservoir 46 are connected by one or more pipes instead of or in addition to one or more holes, and optionally there are not adjacent to each other.

Optionally, a heater 50 heats the desiccant in reservoir 46. Optionally, heater 50 is a heat exchanger, supplied with waste heat from outside source. Alternatively or additionally, heater 50 is an electric heater, or any other kind of heater known to the art. Heater 50 heats the desiccant in reservoir 46 to a high enough temperature so that it gives off moisture, rather than absorbing moisture from the air, at the ambient moisture content of the air. Optionally, heater 50, or another heater, heats the air flowing through regenerating chamber 42, as shown in FIG. 1, in addition to or instead of heating the desiccant in reservoir 46. Heating the air will lower its relative humidity, and cause the desiccant give up moisture to the air at a lower desiccant temperature than would be necessary if the air were not heated. Heating the air will also cause the desiccant to give up moisture to the air more rapidly, at the same desiccant temperature. The air flowing through regenerating chamber 42 exits the chamber through a duct 52, shown only in FIG. 3C, and returns to the ambient environment. Optionally, duct 52 is at the side of chamber 42 opposite to intake duct and fan 19, and the air flowing out of duct 52 is directed into the ambient environment in such a way as to keep it away from either the intake duct of the dehumidifying chamber or the intake duct of the regenerating chamber.

Alternatively, instead of or in addition to using a heat exchanger or heater to heat the desiccant and/or air in regenerating chamber 42, a heat pump is used to transfer heat from dehumidifying chamber 14 to regenerating chamber 42. Other details are optionally incorporated that are described in the description of FIG. 1, or are known to the art. See, for example, the prior art references referred to above.

Other embodiments of the invention employ means other than windmills to circulate the desiccant out of one or both reservoirs, into the air, and back again. Some of these means are described above in the "Summary of Invention." Some of these means involve using a motor to intermittently turn a wheel or belt with desiccant absorbed in it, and with part of the wheel or belt immersed in the reservoir, and part of the wheel or belt exposed to the air flow. Optionally, the motor is automatically turned on when the wheel or belt reaches a certain weight, as moisture is absorbed from the air in the dehumidifying chamber, or as moisture is given off into the air in the regenerating chamber. Alternatively, instead of relying on the changing weight of the desiccant, a chemical sensor, mounted in the absorbent material, detects the moisture, and turns on the motor when the moisture reaches a certain level. Alternatively, the motor turns on at intervals that are calculated by a controller as the time needed to saturate the desiccant in the absorbent material, according to a sensed humidity and temperature of the incoming air. Alternatively, the motor does not make use of feedback at all, but turns on at fixed intervals, independent of the humidity and temperature of the incoming air.

The words "comprise", "have" and "include" and their conjugates as used herein mean "include but are not necessarily limited to." While the invention has been described with reference to certain exemplary embodiments, various modifications will be readily apparent to and may be readily accomplished by persons skilled in the art without departing from the spirit and scope of the above teachings.

The invention claimed is:

1. A dehumidifier for removing moisture from air to be dried and transferring it to environmental air, comprising:

liquid desiccant;

a dehumidifying section;

a dehumidifying section reservoir of having said at least two reservoirs containing at least some of the liquid desiccant; and at least one dehumidifying section element;

wherein each dehumidifying section element moves from the dehumidifying section reservoir to the dehumidifying section, carrying some of the desiccant from the dehumidifying section reservoir with it, which desiccant absorbs moisture from the air to be dried in the dehumidifying section, and the dehumidifying section element then moves back to the dehumidifying section reservoir, carrying the desiccant back to the dehumidifying section reservoir, and wherein the air to be dried moves through the dehumidifying section, and said motion of the air to be dried causes or contributes to causing at least one of the at least one dehumidifying section elements to move.

2. An air-conditioning system for conditioning air by removing heat and moisture from the air and transferring it to the environment, comprising:

the dehumidifier according to claim 1;

a cooling tower that provides at least one non-desiccant fluid at a temperature lower than the temperature of the liquid desiccant in one of the reservoirs; and at least one heat exchanger situated in the one reservoir via which the liquid desiccant in the one reservoir is cooled by the at least one fluid.

3. The air-conditioning system according to claim 2, wherein said cooling tower comprises at least one cooling chamber through which air flows, and which contains water which evaporates into said air, wherein the at least one fluid comprises one or both of air exiting at least one of the at least one cooling chambers and water cooled in at least one of the at least one cooling chambers.

4. The air-conditioning system according to claim 3, wherein the water in at least one of the at least one cooling chambers is sprayed into the air in said cooling chamber.

5. The air-conditioning system according to claim 3, wherein at least some of the air flowing through at least one of the at least one cooling chambers comprises at least some of the dehumidified air produced by the dehumidifier.

6. The air-conditioning system according to claim 3, wherein at least some of the air flowing through at least one of the at least one cooling chambers comprises air that has not been dehumidified by the dehumidifier.

7. The air-conditioning system according to claim 3, wherein at least one of the at least one heat exchangers is in thermal contact with at least one of the at least one cooling chambers.

8. The air-conditioning system according to claim 3, and including a desiccant pump which pumps the desiccant through at least one of the at least one heat exchangers.

9. The air-conditioning system according to claim 3, and including a desiccant reservoir, wherein the liquid desiccant utilized by the dehumidifier is contained at least part of the time in the desiccant reservoir, and at least one of the at least one heat exchangers is in thermal contact with the desiccant reservoir.

10. An air-conditioning system for conditioning air by removing heat and moisture from the air and transferring it to the environment, comprising:

the dehumidifier according to claim 1; and a regenerator, comprising:

a regenerating section;

a regenerating section reservoir of said at least two reservoirs containing at least some of the liquid desiccant; and at least one regenerating section element;

wherein each regenerating section element moves from the regenerating section reservoir to the regenerating section, carrying some of the desiccant from the regenerating section reservoir with it, which desiccant gives up moisture to the environmental air in the regenerating section, and the said regenerating section element then moves back to the regenerating section reservoir, carrying the desiccant back to the regenerating section reservoir.

11. The system according to claim 10, wherein at least one of the at least one dehumidifying section elements moves continuously.

12. The system according to claim 10, wherein at least one of the at least one dehumidifying section elements moves intermittently.

13. The system according to claim 10, wherein the rate at which the desiccant carried by at least one of the at least one dehumidifying section elements is replaced by desiccant from the dehumidifying section reservoir depends on the rate at which the desiccant carried by said dehumidifying section element absorbs moisture from the air to be dried.

14. The system according to claim 10, wherein air moves through the dehumidifying or regenerating section, and said motion of the air to be dried causes or contributes to causing at least one of the at least one dehumidifying or regenerating section elements to move.

15. The system according to claim 14, and including at least one wheel which comprises at least one of the at least one dehumidifying or regenerating section elements, wherein a rotating of the wheel comprises the moving of at least one of the at least one dehumidifying or regenerating section elements that said wheel comprises.

16. The system according to claim 15, wherein at least one of the at least one dehumidifying or regenerating section elements comprises absorbent material.

17. The system according to claim 15, wherein the desiccant adheres to at least one of the at least one dehumidifying or regenerating section elements because of viscosity or surface tension.

18. The system according claim 15, wherein at least one of the at least one dehumidifying or regenerating section elements comprises at least one hollow space, and wherein the desiccant remains in said space for at least a portion of the movement of the element.

19. The system according to claim 3 the at least one fluid comprises air exiting at least one of the at least one cooling chambers.

20. The system according to claim 3 wherein the at least one fluid comprises both of air exiting at least one of the at least one cooling chambers and water cooled in at least one of the at least one cooling chambers.

21. The air-conditioning system according to claim 20, wherein at least some of the air flowing through at least one of the at least one cooling chambers comprises at least some of the dehumidified air produced by the dehumidifier.

22. The air-conditioning system according to claim 20, wherein at least some of the air flowing through at least one of the at least one cooling chambers comprises air that has not been dehumidified by the dehumidifier.

23. The air-conditioning system according to claim 20, wherein at least one of the at least one heat exchangers is in thermal contact with at least one of the at least one cooling chambers.

24. The air-conditioning system according to claim 20, and including a desiccant pump which pumps the desiccant through at least one of the at least one heat exchangers.

25. The air-conditioning system according to claim 2, wherein said cooling tower comprises at least one cooling chamber through which air flows, and which contains water which evaporates into said air, wherein the at least one fluid comprises one or both of air exiting at least one of the at least one cooling chambers and water cooled in at least one of the at least one cooling chambers, wherein at least some of the air flowing through at least one of the at least one cooling chambers comprises at least some of the dehumidified air produced by the dehumidifier.

26. The air-conditioning system according to claim 25, wherein the water in at least one of the at least one cooling chambers is sprayed into the air in said cooling chamber.

27. The air-conditioning system according to claim 25, wherein at least one of the at least one heat exchangers is in thermal contact with at least one of the at least one cooling chambers.

28. The air-conditioning system according to claim 25, and including a desiccant pump which pumps the desiccant through at least one of the at least one heat exchangers.

29. The air-conditioning system according to claim 25, and including a desiccant reservoir, wherein the liquid desiccant utilized by the dehumidifier is contained at least part of the time in the desiccant reservoir, and at least one of the at least one heat exchangers is in direct thermal contact with the desiccant reservoir.

30. A regenerator for removing moisture from a desiccant solution and transferring it to environmental air, comprising:

liquid desiccant;

a regenerating section;

a regenerating section reservoir having at least two reservoirs containing at least some of the liquid desiccant; and at least one regenerating section element;

wherein each regenerating section element moves from the regenerating section reservoir to the regenerating section, carrying some of the desiccant from the regenerating section reservoir with it, which desiccant gives up moisture to the environmental air in the regenerating section, and the said regenerating section element then moves back to the regenerating section reservoir, carrying the desiccant back to the regenerating section reservoir, and wherein air moves through the regenerating section and said motion of the air causes or contributes to causing at least one of the at least one regenerating section elements to move.

* * * * *

UNITED STATES PATENT AND TRADEMARK OFFICE

CERTIFICATE OF CORRECTION

PATENT NO. : 7,905,107 B2
APPLICATION NO. : 10/500053
DATED : March 15, 2011
INVENTOR(S) : Mordechai Forkosh et al.

It is certified that error appears in the above-identified patent and that said Letters Patent is hereby corrected as shown below:

Column 13, Line 44, Claim 1:

After "reservoir"
Delete "of"

Signed and Sealed this
Fourteenth Day of June, 2011

David J. Kappos

David J. Kappos
*Director of the United States Patent and Trademark Office*